United States Patent [19]

Kriebel

[11] Patent Number: 4,489,016

[45] Date of Patent: Dec. 18, 1984

[54] APPARATUS FOR DIFFUSING GASES INTO LIQUIDS

[75] Inventor: John E. Kriebel, Souderton, Pa.

[73] Assignee: Capital Controls Company, Inc., Colmar, Pa.

[21] Appl. No.: 465,729

[22] Filed: Feb. 11, 1983

[51] Int. Cl.[3] ..... B01F 3/04

[52] U.S. Cl. ..... 261/122; 137/853; 210/221.2; 239/145; 261/62; 261/64 R; 261/124; 422/231

[58] Field of Search ..... 261/122, 124, 62, 64 R; 422/231; 239/145; 210/221.2; 209/170; 435/313; 137/853

[56] References Cited

U.S. PATENT DOCUMENTS

| | | | |
|---|---|---|---|
| 1,250,303 | 12/1917 | Greenawalt | 261/124 |
| 3,186,644 | 6/1965 | Ross et al. | 261/124 X |
| 3,206,178 | 9/1965 | Lamb | 261/124 X |
| 3,441,216 | 4/1969 | Good | 261/122 X |
| 3,525,685 | 8/1970 | Edwards | 261/124 X |
| 3,841,997 | 10/1974 | McGee | 261/122 X |
| 4,243,616 | 1/1981 | Wyss | 261/124 X |

*Primary Examiner*—Richard L. Chiesa
*Attorney, Agent, or Firm*—Howson and Howson

[57] ABSTRACT

Apparatus for use in contacting a gas with a liquid comprises a pair of ported injector pipes onto which elastic sleeves having a series of slits therein are mounted by means of axially-spaced bands. The elastic sleeves expand as gas flows from the pipe to open the slits for discharging the gas into the liquid. The apparatus functions to maintain a desired gas flow rate irrespective of the accumulation of gas-liquid reaction products tending to block the slits.

12 Claims, 3 Drawing Figures

APPARATUS FOR DIFFUSING GASES INTO LIQUIDS

FIELD OF THE INVENTION

The present invention relates to gas-liquid contacting apparatus, and more particularly, the present invention relates to apparatus for continuously diffusing a gas into a liquid under conditions where solid reaction products tend to interfere with diffusion at the gas-liquid interface.

BACKGROUND OF THE INVENTION

Various devices are known for contacting gases with liquids. One such device which has been particularly well suited for diffusing chlorine gas into water is the porous stone diffuser sold by Capital Controls Co., Inc. of Colmar, Pa. In brief, the porous stone diffuser comprises a manifold mounting a check valve and a pair of porous stone pipes extending laterally away from the manifold. When immersed in water, gas flows into the pipes and percolates outwardly through the interstices of the stone particles to mix with the water.

While stone diffuser devices perform well when the gas is chlorine, certain problems have been encountered in those applications where it is desired to contact ammonia with water. In such applications, it has been found that solid reaction products tend to form on the surface of the stone diffuser due to the pH of the solution at the point of contact of the ammonia with the water. The solid reaction products tend to accumulate on the surface of the stone diffuser thereby blocking the gas flow therefrom and requiring periodic removal and replacement.

One known attempt to overcome this problem involves the use of a pipe having a central bore communicating with a pair of lateral passages adjacent one end. A peripheral recess is provided in the pipe inwardly adjacent to the lateral ports. A rubber cap is mounted on the end of the pipe and has a peripheral wall which terminates adjacent to the recess. The flow of gas between the cap and the pipe and into the recess is supposed to provide a self-cleaning function. However, in actual practice it has been found that the reaction product accumulates in the recess, thereby requiring periodic shut-down of the diffuser unit for cleaning.

OBJECTS OF THE INVENTION

With the foregoing in mind, a primary object of the present invention is to provide gas-liquid contacting apparatus which overcomes the limitations of known prior art devices.

Another object of the presen invention is to provide a diffuser which is capable of operating continuously with minimal maintenance to diffuser gas into liquid.

A further object of the present invention is to provide a simple and highly reliable device for diffusing a gas into a liquid.

As a still further object, the present invention provides a gas diffuser which is particularly suited for contacting ammonia gas with water in a continuous and trouble-free manner.

SUMMARY OF THE INVENTION

More specifically, the present invention provides gas-liquid contact apparatus which can operate continuously in a trouble-free manner over prolonged periods of time to diffuse gases into liquids, such as ammonia into water. The apparatus comprises a ported injector adapted to receive gas from a pressurized supply and an elastic member mounted to the injector. The elastic member has a plurality of small slits formed therein and it cooperates with the injector to form an expandable chamber for receiving gas emitted from the ported injector. As flow retarding reaction products form on the surface of the elastic member adjacent the slits, pressure in the chamber increases and the elastic member distends to open the slits wider for maintaining gas flow and dislodging any accumulation of reaction product.

BRIEF DESCRIPTION OF THE DRAWINGS

The foregoing and other objects, features and advantages of the present invention should become apparent form the following description when taken in conjunction with the accompanying drawings, in which.

DESCRIPTION OF THE PREFERRED EMBODIMENT

Figure 1:
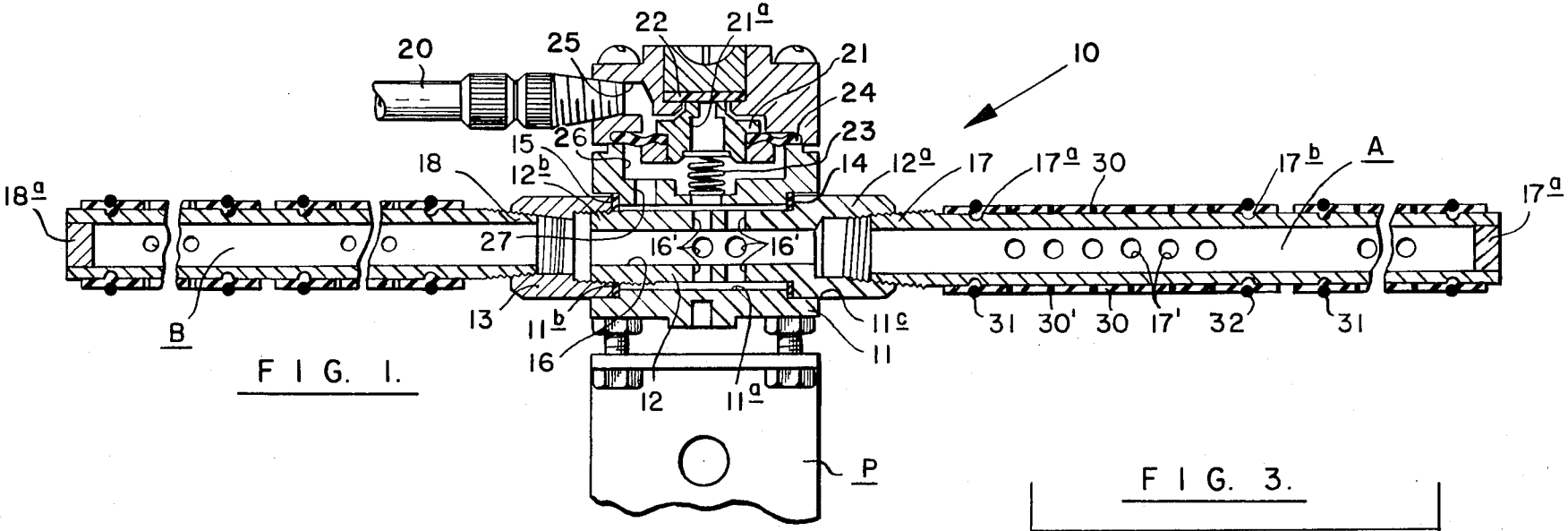
FIG. 1 is a foreshortened, longitudinal sectional view of a gas diffuser embodying the present invention.
Figure 2:
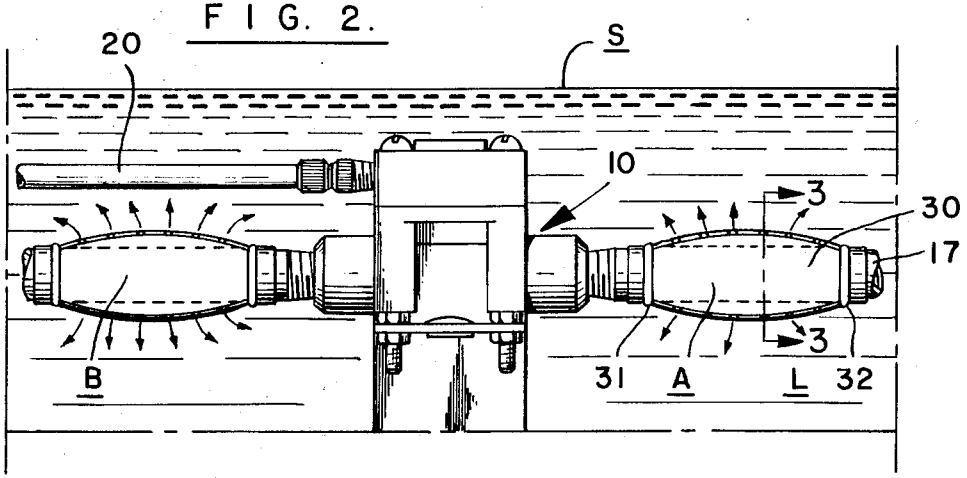
FIG. 2 is an end elevational view, in reduced scale, showing the gas diffuser of FIG. 1 in operation.

Referring now to the drawings, FIG. 1 illustrates gas diffusion apparatus 10 of the present invention. As best seen in FIG. 2, the gas diffusion apparatus 10 is normally submerged in a liquid L below its surface S and is designed to mix gas with the liquid L. To this end, gas is supplied to the apparatus 10 under pressure via supply line 20. The apparatus 10 comprises a central manifold body 11 mounting an identical pair of diffuser arm assemblies A and B from which the gas flows into the ambient liquid L. In the illustrated embodiment, the manifold body 11 is connected to a mounting plate P which is suitably secured below the fluid surface S. As discussed heretofore, the apparatus 10 is particularly well suited for diffusing gaseous ammonia into water continuously at a desired flow rate and with a minimum of maintenance.

To distribute gas laterally to the arms A and B from the supply line 20, the manifold body 11 has a horizontal through bore 11*a* with internally-threaded enlargements 11*b* and 11*c* at opposite ends. An elongated adapter 12, having an enlarged externally-threaded head 12*a* at one end, is threaded into the threaded end 11*c* of the manifold bore 11. The opposite end 12*b* of the adapter is externally-threaded and receives the internal threads of an adapter cap 13.

The adapter 12 has an axial through bore 16 and a series of diametrically extending, centrally located ports 16',16'. The bore 16 opens at opposite ends into the inner ends of injector pipes 17 and 18 in the arm assemblies A and B, respectively, opposite ends of the injector pipes 17 and 18 being closed by plugs 17*a* and 18*a*, respectively. A gasket 14 is provided between the adapter head 12*a* and the manifold body 11 and between the adapter cap 13 and the manifold body 11.

In order to prevent reverse flow of liquid into the gas line 20, a check valve assembly is mounted in the manifold body 11 between the gas line 20 and the adapter 12. To this end, the check valve assembly comprises a valve member 21 which is biased upwardly against a resilient seat 22 by means of a compression spring 23. A diaphragm 24 surrounds the valve member 21 and connects the same to the manifold body 11. The valve member 21 has a vertical port 21*a* which, when spaced from its seat 22, provides gas communication between a threaded inlet 25 and a valve chamber 26 in which the valve member 21 moves. The valve chamber 26, in turn, communicates via a port 27 with a cylindrical chamber surrounding the adapter 12. Thus, gas pressure on the diaphragm 24 forces the valve member 21 downwardly against the bias of its spring 23 to cause gas to be supplied under pressure to the pipes 17 and 18 via the passage 21*a* in the valve body 21, the valve chamber 26, the valve chamber port 27 and the ports 16' and bore 16 in the adapter 12. Reverse flow is prevented when the differential in pressure between the gas inlet 25 and valve chamber 26 is such as to cause the valve member 24 to move upwardly and engage its seat 22.

The gas supplied by the line 20 is diffused at a predetermined controlled rate from the arms A and B of the diffuser assembly 10. For this purpose, the pipes 17 and 18 of the arms A and B are each provided with at least one, and preferably two or more, elastic sleeves, such as the sleeves 30 and 31 shown on the right-hand pipe 17. Each sleeve, such as the sleeve 30 is fabricated of a tube of rubber which is pulled axially onto the pipe 17. To render the sleeve 30 porous, it is provided with a series of apertures, or slits 30', disposed in axially spaced relation between the ends of the sleeve 30. The slits 30' are arranged in diametrically-opposed pairs which are offset angularly with respect to diametrically-arranged pairs of ports 17' in the pipe 17. Preferably, the slits 30' are formed by piercing the sleeve 30 diametrically with a series of small diameter pins when the sleeve 30 is mounted on a mandrel. Since the slits are formed by piercing without removing any of the material of the wall of the sleeve 30, they are normally closed when the sleeve 30 is relatively unstressed in tension, or relaxed, such as shown engaged with the pipe 17 in FIG. 1.

The sleeve 30 is mounted to the pipe 17 in a gas tight manner. For this purpose, a pair of retaining bands 31 and 32 surround the sleeve 30 adjacent its opposite ends to clamp the sleeve 30 to the outer periphery of the pipe 17. In the illustrated embodiment, the bands are O-rings fabricated of rubber, and the outer periphery of the pipe 17 is provided with a pair of grooves 17*a* and 17*b* which cooperate with the O-rings to clamp the sleeve 30 firmly. This arrangement forms an expandable gas chamber 35 (FIG. 3) extending axially along the pipe 17 between its outer periphery and the sleeve 30.

By way of example, and not by way of limitation, a desirable ammonia gas diffuser has pipes 17 and 18 fabricated of polyvinyl chloride with 7/32 inch diameter holes 17' located on about 7/16 inch centers. The sleeve 30 preferably has an overall length of about 4 inches and a wall thickness of about 0.050 inches, with the slits 30' being pierced on about 7/16 inch centers with pointed pins having a diameter of about 0.035 inch. The sleeve is fabricated of EPDM rubber having a durometer in a range of 30 to 50 on the Shore A scale with a preferred durometer of 35. The O-rings are preferably fabricated of the same type rubber. The apparatus 10 is well suited for use with a manual control direct gas pressure control unit, such as the ADVANCE Model 611 unit sold by Capital Controls, Inc. which can be connected in the gas supply line 20 to supply gas at a desired flow rate and pressure.

Figure 3:
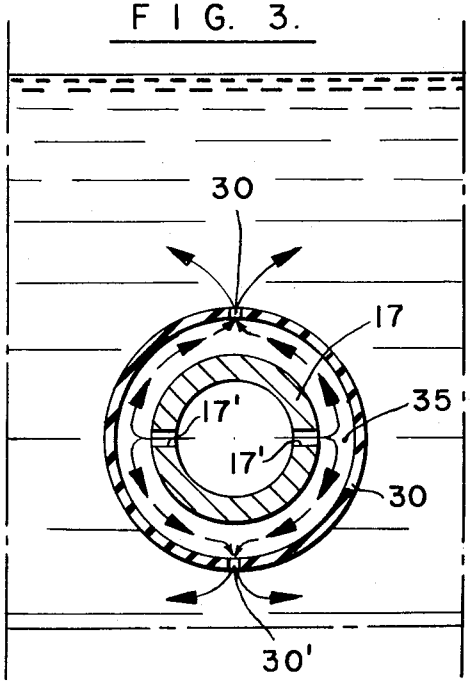
FIG. 3 is an enlarged sectional view taken on line 3—3 of FIG. 2.

In operation, gas conducted into the pipes 17 and 18 via the manifold body 11, flow out each arm assembly A and B in the same manner. For instance, with respect to the right-hand arm A, the gas flows into the pipe 17 and out the ports 17',17' into the expandable chamber 35 surrounding the pipe 17. The gas contained in the chamber 35 flows out into the ambient liquid L via the slits 30' as shown in FIGS. 2 and 3. Depending on various factors, including gas pressure and flow rate, head of liquid L, etc., the chamber 35 will normally be relatively short in length and only slightly greater in diameter than the diameter of the pipe 17.

When the gas is ammonia and the liquid is water, and the apparatus 10 is employed to diffuse the ammonia into the water, a solid reaction product develops at the point of contact of the ammonia gas with the water due to the high pH of the solution adjacent the point of ammonia-water contact. With prior art devices, such solid reaction product would tend relatively quickly to slow down and eventually block the diffusion of ammonia into the water.

With the apparatus of the present invention, however, any reaction product which tends to accumulate on the surface of the elastic sleeve 30, and to block the flow of ammonia through the slits 30', causes pressure in the expandable chamber 35 to increase. Increased pressure causes the sleeve 30 to expand axially and circumferentially such as indicated in FIG. 2. As a result of this distension, the slits 30' in the sleeve 30 increase in size and this, in turn, maintains the flow of ammonia into the water at the desired rate. Such distension of the sleeve 30 also functions to loosen any reaction product which may have formed on the sleeve 30, allowing it to slough-off in the currents formed by the ammonia flowing into the water.

As a result, the apparatus 10 of the present invention functions automatically to diffuse ammonia at a controlled rate into the ambient water. At an ammonia delivery pressure upstream of the manifold inlet 25 of about 10 psig., ammonia is diffused at a maximum rate of about 15 to 25 pounds per day per sleeved length of pipe which, in the illustrated embodiment is about 4 inches. Thus, a gas diffuser 10 of the illustrated construction is capable of diffusing up to about 60 to 100 pounds/day of ammonia into water in a trouble-free manner.

Since the apparatus 10 is self-cleaning, it can operate for prolonged periods of time without requiring any repairs or maintenance. Moreover, because the diffuser apparatus 10 is relatively simple in construction, it is highly reliable in operation yet relatively inexpensive to manufacture.

While the diffuser apparatus 10 is particularly well suited for diffusing ammonia into water, it should be apparent that it may be used in any number of other applications where it is desired to diffuse a gas into a liquid where reaction products tend to interfere with a controlled diffusion rate.

In view of the foregoing, it should be apparent that the present invention now provides an improved gas diffuser which can operate effectively for prolonged periods of time with minimal maintenance.

While a preferred embodiment of the present invention has been described in detail, various modifications, alterations and changes may be made without departing from the spirit and scope of the present invention as defined in the appended claims.

I claim:

1. In a liquid in which an immersed injector having a chamber for containing gas under pressure and at least one port through which the gas flows for contact with the liquid at a predetermined gas flow rate and in which said gas interacts with the liquid at the point of contact therewith to form a solid product capable of accumulating on the injector and reducing said gas flow rate, the improvement comprising: elastic means mounted on said injector and operable periodically in response to an accumulation of said product thereon to clean itself automatically for maintaining said predetermined gas flow rate, said elastic means being interposed between said injector port and said liquid and cooperating with said injector to form an expandable chamber therebetween for receiving gas from said injector chamber, said elastic means having a plurality of pin-sized apertures through which the gas flows to contact the liquid, said elastic means distending into a predetermined normal configuration during gas flow from said expandable chamber through said pin-sized apertures at said predetermined gas flow rate when said apertures are clean of said solid product, said gas contacting said liquid and forming said solid product on said elastic means adjacent to said pin-sized apertures in the course of operation of said injector, said solid product accumulating on said elastic means to restrict gas flow through said pin-sized apertures, said gas flow restriction caused by said solid product increasing gas pressure in said expandable chamber for distending said elastic means from its normal distended configuration and increasing its size and the size of said pin-sized apertures therein to maintain said gas flow rate, further accumulations of said solid product on said elastic means further restricting gas flow through said pin-sized apertures and causing said elastic means to distend further and increase in size for fracturing said solid product thereon and causing said solid product to slough off into the liquid, said elastic means, after having distended from its normal configuration to clean said apertures of said solid product, contracting into its normal configuration to reduce the size of said pin-sized apertures for maintaining said predetermined gas flow rate, said elastic means thereby cooperating with said solid product and said gas in said expandable chamber to continuously modulate its size and the size of said apertures therein in the course of operation of said injector for automatically and periodically cleaning itself of the solid product and thereby maintaining said predetermined gas flow rate.

2. Apparatus according to claim 1 wherein said injector includes an elongated pipe and said elastic means includes a tubular member surrounding said pipe along at least a portion of its length.

3. Apparatus according to claim 2 including means surrounding and engaging said elastic means at spaced locations along said pipe for retaining said tubular elastic means in gas tight engagement with said pipe.

4. Apparatus according to claim 3 wherein said retaining means includes a pair of bands.

5. Apparatus according to claim 4 wherein each of said bands is an annulus formed of an elastomeric material.

6. Apparatus according to claim 5 wherein said retaining means further includes a pair of grooves in the periphery of said pipe for receiving said tubular elastic means adjacent its opposite ends.

7. Apparatus according to claim 1 wherein said pipe has a plurality of said ports disposed in diametrically-opposed rows, and said apertures in said tubular elastic member are located out of registry with said pipe ports.

8. Apparatus according to claim 1 wherein said injector means includes a manifold and at least one arm connected to said manifold and including a pipe mounting said elastic means thereon.

9. Apparatus according to claim 8 including another arm like in construction to said first arm and aligned with one another on opposite sides of said manifold, and each pipe in said arms mounting a series of said elastic members in axially spaced relation thereon.

10. Apparatus according to claim 1 including a check valve carried by said manifold to provide unidirectional flow into said injector means.

11. Apparatus according to claim 1 wherein said apertures in said elastic means include slits which are closed when said elastic means is relatively unstressed in tension and which tend to open as said elastic means is stressed in tension.

12. In a liquid in which an immersed injector having a chamber for containing gas under pressure and at least one port through which the gas flows for contact with the liquid at a predetermined gas flow rate and in which said gas interacts with the liquid at the point of contact therewith to form a solid product capable of accumulating on the injector and reducing said gas flow rate, the improvement wherein said injector comprises:

a manifold adapted to contain gas under pressure, a check valve mounted in said manifold, a plurality of elongated pipes connected to said manifold for receiving said gas, each of said pipes having a series of ports therein, an elastic sleeve surrounding at least a portion of the length of each pipe and overlying said ports therein, means clamping said sleeve to said pipe at spaced axial locations for causing said sleeve to cooperate with said pipe to define an expandable chamber therebetween, said elastic sleeve having a series of pin-sized slits formed therein without the removal of sleeve material so that the slits are normally closed when said sleeve is in a relaxed state, said elastic sleeve distending into a predetermined normal configuration during gas flow from said expandable chamber through said pin-sized slits at said predetermined gas flow rate when said slits are clean of said solid product, said gas contacting said liquid and forming said solid product on said elastic sleeve adjacent to said pin-sized slits in the course of operation of said injector, said solid product accumulating on said sleeve to restrict gas flow through said pin-sized slits, said gas flow restriction caused by said solid product increasing gas pressure in said expandable chamber for distending said elastic sleeve from its normal distended configuration and increasing its size and the size of said pin-sized slits therein to maintain said gas flow rate, further accumulations of said solid product on said elastic sleeve further restricting gas flow through said pin-sized slits and causing said elastic sleeve to distend further and increase in size for fracturing said solid product thereon and causing said solid product to slough off into the liquid, said elastic sleeve, after having distended from its normal configuration to clean said slits of said solid product, contracting into its normal configuration to reduce the size of said pin-sized slits for maintaining said predetermined gas flow rate, said elastic sleeve thereby cooperating with said solid product and said gas in said expandable chamber to continuously modulate its size and the size of said slits therein in the course of operation of said injector for automatically and periodically cleaning itself of the solid product and thereby maintaining said predetermined gas flow rate.

* * * * *